United States Patent [19]

Brotherton

[11] Patent Number: 4,926,364

[45] Date of Patent: May 15, 1990

[54] METHOD AND APPARATUS FOR DETERMINING WEIGHTED AVERAGE OF PROCESS VARIABLE

[75] Inventor: Walter W. Brotherton, Monroeville, Pa.

[73] Assignee: Westinghouse Electric Corp., Pittsburgh, Pa.

[21] Appl. No.: 223,306

[22] Filed: Jul. 25, 1988

[51] Int. Cl.[5] ..... G08B 19/00

[52] U.S. Cl. ..... 364/581; 364/571.02; 364/575; 364/557; 340/501; 340/508; 307/441; 376/247

[58] Field of Search ..... 364/575, 581, 571.02.557; 307/357, 441; 328/137; 340/501, 508; 376/246, 247, 249

[56] References Cited

U.S. PATENT DOCUMENTS

| | | | |
|---|---|---|---|
| 4,414,540 | 11/1983 | Dickenson | 340/508 |
| 4,596,024 | 6/1986 | Thomson | 364/575 |
| 4,635,209 | 1/1987 | Hwang et al. | 364/494 |
| 4,700,174 | 10/1987 | Sutherland et al. | 364/571.02 |
| 4,707,621 | 11/1987 | Arita et al. | 307/441 |
| 4,725,820 | 2/1988 | Kimura | 340/508 |
| 4,745,398 | 5/1988 | Abel et al. | 340/508 |
| 4,800,513 | 1/1989 | Deutsch | 364/571.02 |

*Primary Examiner*—Parshotam S. Lall
*Assistant Examiner*—Brian M. Mattson
*Attorney, Agent, or Firm*—B. R. Nath

[57] ABSTRACT

A method and apparatus for determining a weighted average of three input values under the control of a processor includes a step of determining which of the three input values is the median value, with the remaining input values being first and second values. Then, first and second weighting factors are calculated based on a predetermined median weighting factor and the three input values. Finally, a weighted average is calculated based on the first and second weighting factors, the predetermined median weighting factor, the first and second input values and the median input value. The three input values may be sensed values provided by a temperature sensor in a nuclear power plant.

16 Claims, 1 Drawing Sheet

METHOD AND APPARATUS FOR DETERMINING WEIGHTED AVERAGE OF PROCESS VARIABLE

BACKGROUND OF THE INVENTION

This invention relates to the measurement of process variables by sensors, and particularly to the processing of sensor signals to obtain an accurate weighted average based on sensor signals provided by three or more sensors which are measuring the same process variable.

There are, in existence, many sensing systems for measuring a variety of variables including, for example, temperature, pressure, level, flow rate, amplitude, voltage, current, power, etc. In those circumstances where it is particularly critical that the measured value be accurate and protected against failure, it is common practice to employ three redundant sensors to measure the same variable. This is often referred to as triple redundancy.

One environment in which triple redundancy is employed is a nuclear power plant. In a nuclear power plant, certain process variables are measured by three redundant sensors in order to ensure the continuous availability of an accurate sensing signal, without any down time due to a failure of the sensor itself. The reliability of such systems employing triple redundancy is significantly enhanced if the accuracy of the final numerical value which is obtained can be maintained even if one of the three sensors fails to operate. Failure of a sensor typically occurs in one of three modes with approximately equal probability. The first mode is a failure with a zero output, the second mode is a failure with a very high output, and the third mode is a failure in such a way that a value is produced which drifts (in finite time) away from the correct value, due to a component or material failure.

Prior art methods and apparatus have applied consistency tests to the three sensed values, and as soon as one of the three values fails a consistency test, that value is removed from any influence on the final numerical value. For example, the inconsistent value may be immediately removed from an averaging calculation. The discontinuous nature of this abrupt removal of the inconsistent value can produce steps in the output value, which may in turn produce deleterious effects in downstream operations. Further, oscillations may be generated when a given signal is on the verge of a change of state from one set of averages to another at the time an inconsistent value is removed from the averaging calculation. Thus, there is a need in the art for a method and apparatus for redundant measurement of variables, which produces a continuous output and which takes into account the fact that transients may occur in the system being monitored.

SUMMARY OF THE INVENTION

It is an object of the present invention to provide a method and apparatus for determining a weighted average of three input values which overcomes the deficiencies of the prior art.

In particular, it is an object of the present invention to provide a method and apparatus for determining a weighted average wherein when one of a plurality of inputs deviates sufficiently from the median of the inputs, its influence on the output shall diminish in accordance with the amount of its deviation.

It is a further object of the present invention to provide a method and apparatus for determining a weighted average which may be applied to the monitoring of process variables in a nuclear power plant.

The method of determining a weighted average of three input values in accordance with the present invention includes determining which of the three input values is the median value, with the remaining input values being first and second input values. First and second weighting factors are calculated based on a predetermined median weighting factor and the three input values. Then, a weighted average is calculated based on the first and second weighting factors, the median weighting factor, the first and second input values and the median value.

The apparatus of the present invention includes means for sensing the same variable and for providing three sensed values. A processor receives the three sensed values, and determines which of the sensed values is the median value, with the remaining sensed values being first and second sensed values. The processor calculates first and second weighting factors based on a predetermined median weighting factor and the three sensed values. The processor calculates a weighted average based on the first and second weighting factors, the median weighting factor, the first and second sensed values, and the median value.

These together with other objects and advantages which will become subsequently apparent, reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
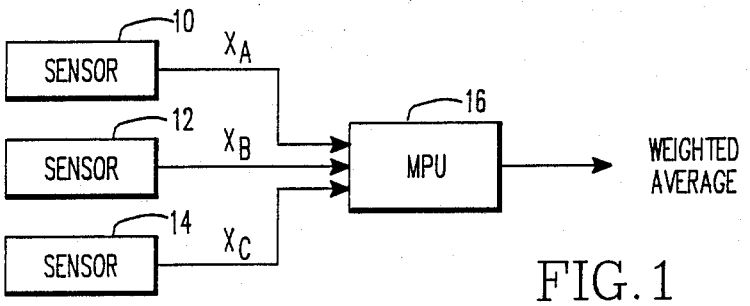
FIG. 1 is a block diagram of an apparatus for determining a weighted average of three input values in accordance with an embodiment of the present invention.

Referring to FIG. 1, sensors 10, 12 and 14 produce input values $X_A$, $X_B$ and $X_C$, respectively. While the means for producing the input values $X_A$, $X_B$ and $X_C$ are, in the preferred embodiments, sensors which produce measured values, in fact, the method and apparatus of the present invention may be employed to process input values produced by any suitable means. In one embodiment of the invention, the sensors 10, 12 and 14 are sensors for sensing the same process variable in a nuclear power plant. For example, the sensors 10, 12 and 14 may be for sensing temperature, pressure, vessel level or fluid flow rate, so that the input values $X_A$, $X_B$ and $X_C$ represent separate sensing signals from the three redundant sensors 10, 12 and 14. The input values $X_A$, $X_B$ and $X_C$ are provided to a microprocessor 16 which processes the input values $X_A$, $X_B$ and $X_C$ to produce a weighted average signal in accordance with the method of the present invention. If, for example, the input values $X_A$, $X_B$ and $X_C$ are temperature sensing signals, the microprocessor 16 will generate a single temperature sensing signal which is the weighted average of the three temperature sensing signals $X_A$, $X_B$ and $X_C$ input to the microprocessor 16. The weighted average signal may be used for control purposes or may be provided to a display to display the weighted average.

The method of the present invention is a nonlinear method of exaggerating a deviation from the median by one of the input values. As a result, a large error in one of the input values will have substantially no effect on the weighted average which is output. In accordance with the method of the present invention, the one of the input values $X_A$, $X_B$ and $X_C$ which is the median value is identified. Then, three weighting factors a, b and c are determined based on a predetermined median weighting factor corresponding to the median input value, and first and second absolute values which are equal to the absolute values of the differences between the median value and the remaining two of the input values $X_A$, $X_B$ and $X_C$. Finally, the weighted average Y is calculated in accordance with the following equation:

$$Y=aX_A+bX_B+cX_C \quad (1)$$

Figure 2:
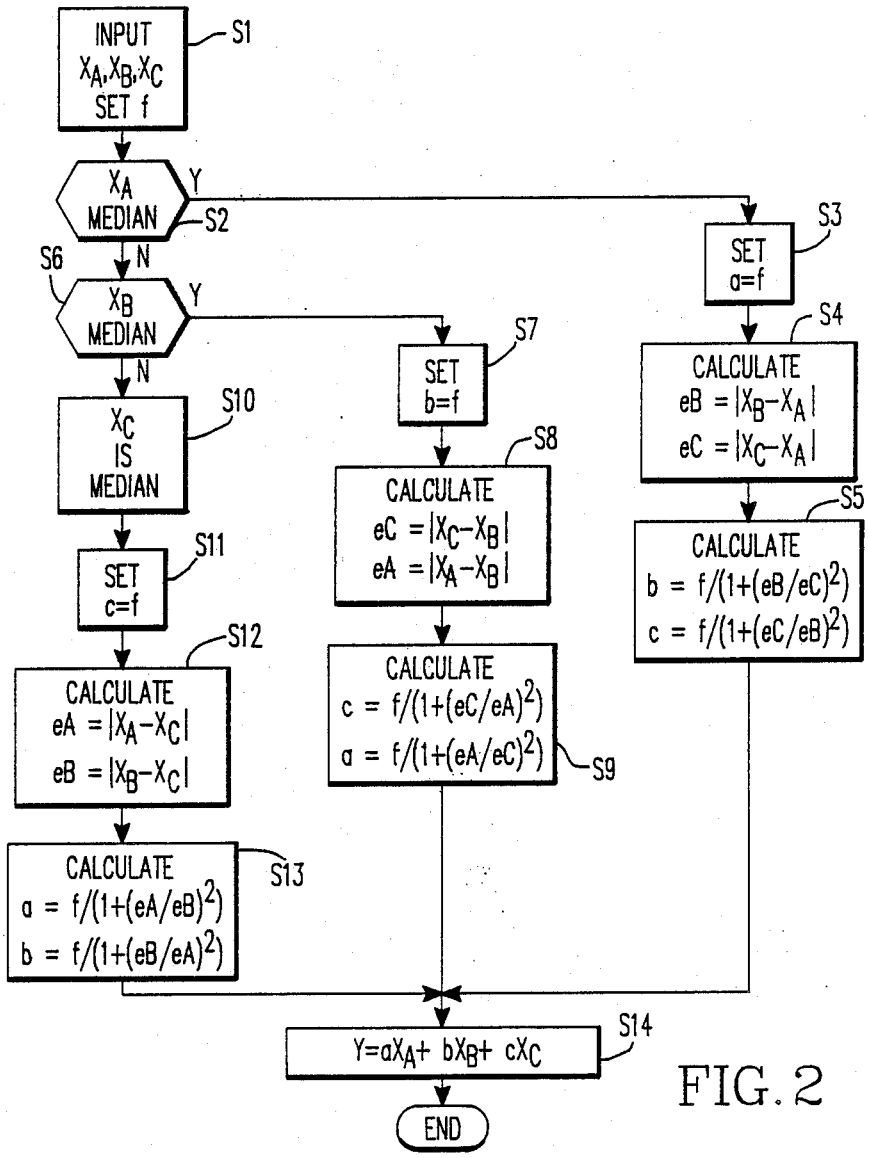
FIG. 2 is a flowchart for describing the operation of the microprocessor 16 of FIG. 1, and for describing the method for determining a weighted average in accordance with the present invention.

FIG. 2 is a flowchart for describing the operation of the microprocessor 16 of FIG. 1 and for describing the steps of the method of the present invention. First, the input values $X_A$, $X_B$ and $X_C$ are input to the microprocessor 16 and a predetermined median weighting factor f is determined in a step Sl. In the preferred embodiment, f is selected to be equal to 0.5 in order to ensure that when an output is at an extreme value (i.e., either zero or a very high value), the weighted average which is generated will consist of the average of the two remaining "good" values. Of course, f can be set to a different fractional value if different results are desired to be achieved. Then it is determined if the input value $X_A$ is the median one of the input values in a step S2. If $X_A$ is the median value, then the weighting factor a is set equal to the predetermined median weighting factor f in a step S3. Next, the absolute values of the differences between $X_B$ and $X_A$, and between $X_C$ and $X_A$ are calculated to determine absolute values eB and eC in a step S4. Next, the remaining weighting factors b and c are calculated in a step S5. The weighting factors b and c are calculated in accordance with the following equations:

$$b=f/(1+(eB/eC)^2) \quad (2)$$

$$c=f/(1+(eC/eB)^2) \quad (3)$$

Alternatively, weighting factor c may be calculated based on the equation $a+b+c=1$.

If it is determined in step S2 that $X_A$ is not the median value, then it is determined whether $X_B$ is the median value in a step S6. If $X_B$ is the median value then weighting factor b is set equal to the predetermined median weighting factor f in a step S7. Next, the absolute values of the differences between $X_C$ and $X_B$ (eC), and between $X_A$ and $X_B$ (eA) are determined in a step S8 to obtain the absolute values eC and eA, respectively. Then, in a step S9 the remaining weighting factors c and a are determined in accordance with the following equations:

$$c=f/(1+(eC/eA)^2) \quad (4)$$

$$a=f/(1+(eA/eC)^2) \quad (5)$$

If it is determined in step S6 that $X_B$ is not the median value, then it is determined that $X_C$ is the median value in a step S10 and the weighting factor c is set equal to the predetermined median weighting factor f in a step S11. Next, the absolute values of the differences between $X_A$ and $X_C$ (eA), and between $X_B$ and $X_C$ (eB) are calculated in a step S12 in order to obtain absolute values eA and eB. Then, in a step S13, weighting factors a and b are calculated in accordance with the following equations:

$$a=f/(1+(eA/eB)^2) \quad (6)$$

$$b=f/(1+(eB/eA)^2) \quad (7)$$

As indicated above with respect to S5, the calculations for steps S9 and S13 can be simplified based on the fact that the sum of the weighting factors $a+b+c=1$.

After the weighting factors a, b and c have been determined in step S5, step S9 or step S13, then the weighted average Y is calculated in a step S14 in accordance with equation (1) above.

As explained above, there is some flexibility in the method of the present invention to achieve the desired results for the particular types of sensors used or the system being monitored, by varying the value of the predetermined median weighting factor f. The weighted average value which is generated in accordance with the method of the present invention is more accurate than any single one of the input values. As a result of random variation, each of the sensing signals is typically off by some amount from the weighted average, but this would also be true in the case where the values are simply averaged.

Examples of the application of the method of the present invention are set forth below.

EXAMPLE 1:

In the following example, input value $X_A$ is assumed to have a value of 500 and input value $X_B$ is assumed to have a value of 500.5 which may result from a normal random inaccuracy. In this example, the input value $X_C$ is assumed to start off with a normal random inaccuracy (Case 1) and then fail suddenly to produce a zero output (Case 2). The weighted average Y is calculated for each case using the method of the present invention.

Case 1:

$X_A=500$, $X_B=500.5$, $X_C=499.5$;
$Y=500.0$

Case 2:

$X_A=500$, $X_B=500.5$, $X_C=0$;
$Y=500.25$

Thus, whether input $X_C$ indicates normal operation (Case 1) or a sudden failure (Case 2), the weighted average remains substantially the same and no discontinuity is produced in the weighted average which is generated. It should be noted that the result for Case 2 is the average of $X_A$ and $X_B$.

EXAMPLE 2:

In the following, input value $X_A$ is assumed to have a value of 500, and input value $X_B$ is assumed to have a value of 499.5 which may result from a normal random inaccuracy. The input value $X_C$ is assumed to start off with a normal random inaccuracy (Case 1) and then drift to progressively higher values (Cases 2–4), as it might under conditions of a progressive failure. The weighted average Y is calculated for each case using the method of the present invention.

Case 1:

$X_A=500$, $X_B=499.5$, $X_C=500.5$; $Y=500.0$

Case 2:

$X_A=500$, $X_B=499.5$, $X_C=505$; $Y=499.78$

Case 3:

$X_A=500$, $X_B=499.5$, $X_C=510$; $Y=499.76$

Case 4:

$X_A=500$, $X_B=499.5$, $X_C=600$; $Y=499.75$

From the above, it is clear that the influence of the drifting input value $X_C$ upon the weighted average diminishes quickly as $X_C$ departs from the median, until the result finally becomes the average of $X_A$ and $X_B$.

As indicated above, the method and apparatus of the invention can be applied to a temperature monitoring system in a nuclear power plant. For example, the sensors 10, 12 and 14 in FIG. 1 may be resistance thermometers which produce, as the input values $X_A$, $X_B$ and $X_C$, temperature signals. For example, resistance thermometers are used extensively in nuclear power plants to monitor the temperature of fluids which flow throughout the system.

The method and apparatus of the present invention provide significant advantages. When all three inputs agree within a tolerance that might be expected from random variation without actual failure, the output is a statistically significant function of the inputs; that is, it is a value that is statistically more accurate than each of the inputs alone. Further, when one of the inputs deviates sufficiently from the median value of the inputs, its influence on the output is diminished in accordance with the amount of its deviation. There is no discontinuity or step in the output such as that which results in the prior art from a sudden decision by the system being monitored to operate in a new mode; for example, when one of the outputs is removed. This is because in the method of the present invention none of the input values is discarded from consideration. Instead, when a particular input is at an extreme value (e.g., either zero or very high) the weighted average essentially consists of the average of the two remaining "good" values. However, if a value departs from the median, it is not locked out but instead remains a candidate for influencing the output should it later return to normal. Further, the method of the present invention does not require that a detected error be continuously present in order to maintain corrective action. Since the method of the present invention is a non-linear method for exaggerating a deviation from the median, a large error will have no effect on the weighted average which is output by the microprocessor 16. If a sensor drifts away from the median value and then corrects itself (e.g., in the case of a transient or a self-correcting malfunction) it will be weighted accordingly (i.e., the drifting sensor will have little impact on the weighted average when it is far away from the median, and greater impact on the weighted average when it is close to the median).

The method and apparatus of the present invention may be implemented in numerous ways. For example, a variety of types of sensors and measurement devices may be used to provide input values to the microprocessor 16 in order to produce a weighted average as an output. Further, although the method of the present invention is illustrated as being implemented by a processor, it could also be implemented by discrete circuitry. While the weighted average is disclosed as being produced with respect to three input values, the weighted average may be produced for a larger number of input values if desired.

The many features and advantages of the invention are apparent from the detailed specification, and thus it is intended by the appended claims to cover all such features and advantages of the system which fall within the true spirit and scope of the invention. Further, since numerous modifications and changes will readily occur to those skilled in the art, it is not desired to limit the invention to the exact construction and operation shown and described and, accordingly, all suitable modifications and equivalents may be resorted to, falling within the scope of the invention.

What is claimed is:

1. A method for converting sensor signals into a combined sensor signal which is a weighted average of three input sensor values corresponding to a single process variable under control of a processor, comprising the steps of:

(a) determining which of the three input sensor values is a median input value, the input sensor values other than the median input value being first and second input values;

(b) calculating first and second weighting factors based on a predetermined median weighting factor and the three input sensor values; and (c) producing the combined sensor signal by calculating a weighted average based on the first and second weighting factors, the predetermined median weighting factor, the first and second input values and the median input value.

2. A method according to claim 1, wherein said step (b) comprises the substeps of:

(b1) calculating first and second absolute values which are equal to absolute values of differences between the median input value and the first and second input values, respectively;

(b2) calculating the first weighting factor based on the predetermined median weighting factor and the first and second absolute values; and (b3) calculating the second weighting factor based on the first weighting factor and the predetermined median weighting factor.

3. A method according to claim 2, wherein said step (c) comprises calculating the weighted average by adding together results of multiplying the predetermined median weighting factor times the median input value, multiplying the first weighting factor times the first input value, and multiplying the second weighting factor times the second input value.

4. A method according to claim 3, wherein:

said substep (b2) comprises performing the calculation $f/(1+(A_1/A_2)^2)$ to obtain the first weighting factor, where f is equal to the predetermined median weighting factor, and $A_1$ and $A_2$ are the calculated first and second absolute values; and said substep (b3) comprises calculating the second weighting factor based on the first weighting factor and the predetermined median weighting factor.

5. A method according to claim 4, wherein a sum of the first weighting factor, the second weighting factor and the predetermined median weighting factor is 1.

6. A method according to claim 2, wherein a sum of the first weighting factor, the second weighting factor and the predetermined median weighting factor is 1.

7. A method according to claim 1, wherein said step (b) comprises the substeps of:

(b1) calculating first and second absolute values which are equal to absolute values of differences between the median input value and the first and second input values, respectively;

(b2) calculating the first weighting factor based on the predetermined median weighting factor and the first and second absolute values; and (b3) calculating the second weighting factor based on the predetermined median weighting factor and the first and second absolute values.

8. A method according to claim 7, wherein said step (c) comprises calculating the weighted average by adding together results of multiplying the predetermined median weighting factor times the median input value, multiplying the first weighting factor times the first input value, and multiplying the second weighting factor times the second input value.

9. A method according to claim 8, wherein:

said substep (b2) comprises performing the calculation $f/(1+(A_1/A_2)^2))$ to obtain the first weighting factor, where f is equal to the predetermined median weighting factor, and $A_1$ and $A_2$ are the calculated first and second absolute values; and said substep (b3) comprises performing the calculation $f/(1+(A_2/A_1)^2))$ to obtain the second weighting factor.

10. A method according to claim 1, wherein the three input sensor values correspond to a sensed process variable, and wherein said step (b) comprises the substeps of:

(b1) calculating first and second absolute values which are equal to absolute values of differences between the median input value and the first and second input values, respectively;

(b2) calculating the first weighting factor based on the predetermined median weighting factor and the first and second absolute values; and (b3) calculating the second weighting factor based on the first weighting factor and the predetermined median weighting factor.

11. A method according to claim 10, wherein said step (c) comprises calculating the weighted average by adding together results of multiplying the predetermined median weighting factor times the median input value, multiplying the first weighting factor times the first input value, and multiplying the second weighting factor times the second input value.

12. A method according to claim 11, wherein:

said substep (b2) comprises performing the calculation $f/(1+(A_1/A_2)^2)$ to obtain the first weighting factor, where f is equal to the predetermined median weighting factor, and $A_1$ and $A_2$ are the calculated first and second absolute values; and said substep (b3) comprises calculating the second weighting factor based on the first weighting factor and the predetermined median weighting factor.

13. A method according to claim 12, wherein the sum of the first weighting factor, the second weighting factor and the predetermined median weighting factor is 1.

14. Apparatus for converting sensor signals into a combined sensor signal which is a weighted average of three input sensor values corresponding to a single process variable, comprising:

means for providing the three input sensor values; and a processor for receiving the three input sensor values, for determining which of the three input sensor values is a median input value, the input sensor values other than the median input value being first and second input values, said processor for calculating first and second weighting factors based on a predetermined median weighting factor and the three input sensor values, and for producing the combined sensor signal by calculating a weighted average based on the first and second weighting factors, the predetermined median weighting factor, the first and second input values, and the median input value.

15. Apparatus according to claim 14, wherein said means for providing the three input sensor values comprises first, second and third sensors for sensing a process variable and for providing the three input sensor values.

16. Apparatus for converting sensor signals into a combined sensor signal which is a weighted average of a process variable for a nuclear power plant, comprising:

first, second and third sensors for measuring a process variable corresponding to operation of a portion of the nuclear power plant, and for generating respective sensed values; and a processor for receiving the sensed values, for determining which of the sensed values is a median value, the sensed values other than the median value being first and second sensed values, said processor for calculating first and second weighting factors based on a predetermined median weighting factor and the second values, and for producing the combined sensor signal by calculating a weighted average based on the first and second weighting factors, the predetermined median weighting factor, the first and second sensed values and the median value.

* * * * *